US008698045B2

(12) United States Patent
Daniels et al.

(10) Patent No.: US 8,698,045 B2
(45) Date of Patent: Apr. 15, 2014

(54) HEATING BLANKET

(75) Inventors: Michael Daniels, Shipley (GB); Philip Wilkie, Shipley (GB)

(73) Assignee: Thermocable (Flexible Elements) Limited, West Yorkshire (GB)

( * ) Notice: Subject to any disclaimer, the term of this patent is extended or adjusted under 35 U.S.C. 154(b) by 1347 days.

(21) Appl. No.: 10/564,566

(22) PCT Filed: Jul. 14, 2004

(86) PCT No.: PCT/GB2004/003054
§ 371 (c)(1),
(2), (4) Date: Jan. 13, 2006

(87) PCT Pub. No.: WO2005/009080
PCT Pub. Date: Jan. 27, 2005

(65) Prior Publication Data

US 2006/0186113 A1 Aug. 24, 2006

(30) Foreign Application Priority Data

Jul. 15, 2003 (GB) ..... 0316506.5

(51) Int. Cl.
*H05B 1/00* (2006.01)

(52) U.S. Cl.
USPC ..... 219/212

(58) Field of Classification Search
USPC ..... 219/212, 549, 505, 528, 517, 501, 503; 338/26
See application file for complete search history.

(56) References Cited

U.S. PATENT DOCUMENTS

| | | | | |
|---|---|---|---|---|
| 3,222,497 | A * | 12/1965 | Gordon, Jr. | 219/212 |
| 3,375,477 | A | 3/1968 | Kawazoe | |
| 4,205,223 | A | 5/1980 | Cole | |
| 4,503,322 | A | 3/1985 | Kishimoto et al. | |
| 4,677,281 | A * | 6/1987 | Mills | 219/505 |
| 5,206,485 | A | 4/1993 | Srubas et al. | |
| 5,403,992 | A * | 4/1995 | Cole | 219/528 |
| 5,451,747 | A | 9/1995 | Sullivan et al. | |
| 6,310,332 | B1 | 10/2001 | Gerrard | |
| 6,492,629 | B1 * | 12/2002 | Sopory | 219/535 |
| 6,756,572 | B2 | 6/2004 | Lee | |

FOREIGN PATENT DOCUMENTS

| | | | |
|---|---|---|---|
| DE | 4019698 | A1 | 1/1992 |
| DE | 4124187 | C1 | 11/1992 |
| DE | 10126066 | A1 | 12/2002 |
| DE | 20204494 | U1 | 6/2003 |
| DE | 20303711 | U1 | 7/2003 |
| EP | 0562850 | A2 | 9/1993 |
| EP | 0566302 | | 10/1993 |

(Continued)

*Primary Examiner* — Tu B Hoang
(74) *Attorney, Agent, or Firm* — Smyrski Law Group, A.P.C.

(57) ABSTRACT

A heating cable and associated heating blanket. The heating cable comprises conductors extending along the length of the cable separated by a separation layer. The conductors and separation layer may be coaxial. The conductors are connected at one end of the cable in series such that if the conductors are connected at the other end of the cable to respective poles of a power supply equal currents flow in opposite directions through adjacent portions of the conductors, substantially eliminating electromagnetic radiation from the cable. One conductor has a positive temperature characteristic and the separation layer has either a negative temperature characteristic or melts at a predetermined threshold temperature. Power may be modulated in response to variations in the resistance of the positive temperature co-efficient conductor. Power to the cable may be terminated in the event of current flowing through the separation layer exceeding a predetermined threshold.

6 Claims, 2 Drawing Sheets

(56) References Cited

FOREIGN PATENT DOCUMENTS

Figure 1:
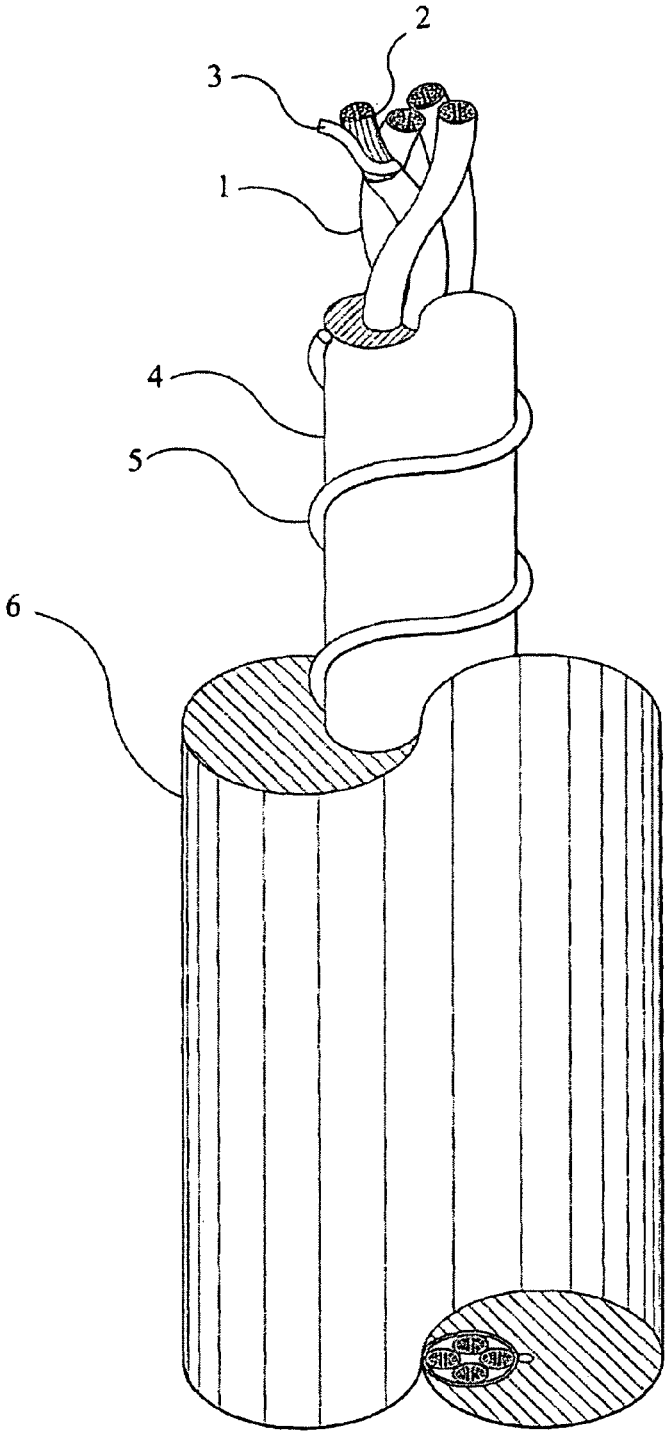

| | | | |
|---|---|---|---|
| EP | 0910227 | A2 | 4/1999 |
| EP | 0566302 | B1 | 10/2001 |
| EP | 1036486 | B1 | 7/2002 |
| EP | 0668646 | B1 | 4/2003 |
| FR | 2590433 | | 5/1987 |
| GB | 2384631 | | 7/2003 |
| JP | 7006867 | | 1/1995 |
| JP | 2001526456 | | 12/2001 |
| JP | 2002367761 | | 12/2002 |
| NZ | 24320 | | 10/1995 |
| NZ | 243204 | | 10/1995 |
| WO | WO-99/30535 | | 6/1999 |
| WO | 0070916 | | 11/2000 |
| WO | WO-03/077397 | A1 | 9/2003 |

* cited by examiner

HEATING BLANKET

The present invention relates to a heating blanket. The term heating blanket is used herein in a broad sense to include any article incorporating an electrical heating cable, for example an under blanket (typically placed beneath a sheet on a bed), an over blanket (typically draped over a sleeping person), a heating pad (a relatively small article which may be applied by a user to a particular part of the users body) or the like.

Safety is a major issue in the case of heating blankets, particularly with heating blankets which are used to warm for example bedding. The primary safety issue is that of over heating. Despite attempts to address this issue it is still the case that at the beginning of the twenty first century serious injury and some times death occurs as a result of for example bedding catching fire due to over heating of an under blanket. A secondary but nevertheless significant issue is that of exposure to radiation (generally referred to as the EMF effect) as a result of a user being in close proximity to a conductor carrying an alternating current.

An early attempt to address the overheating issue is described in U.S. Pat. No. 3,375,477. This document describes a heating cable made up of a first conductor through which heating current flows, and a second conductor which extends along the length of but is separated from the first conductor by a separation layer. The separation layer has a negative temperature coefficient (NTC) such that the resistance of the layer reduces with increasing temperature. Current leaking to the second conductor through the separation layer is detected and used to interrupt the supply of power into the first conductor in the event that the leaking current exceeds a predetermined threshold. An additional safety cut off is provided by a device which cuts off the supply of power if the supplied current exceeds a threshold. The NTC separation layer is designed so that it is not destroyed in the event of overheating and therefore the blanket is not designed to be rendered permanently inoperable as a result of being subjected to an excess temperature on one occasion.

A product of the general type described in U.S. Pat. No. 3,375,477 has been marketed in the United Kingdom. That product is a coaxial structure made up of an inner conductive core, a separation layer formed around the core, a heating wire spiralled around the separation layer, and an outer jacket of insulation. The inner core is made up of a bundle of twisted together components, each of those components being made up of a core of synthetic fibre around which a strip of conductive foil is wrapped. Such a structure, generally referred to as a "tinsel", is used in many heating blankets as it is highly flexible and of relatively low bulk. An NTC separation layer is then extruded onto the twisted core, the heating wire is helically wound onto the separation layer, and the outer insulation jacket is extruded over the wire and separation layer. In use, the opposite ends of the heating wire are connected to opposite poles of a power supply, generally at mains voltage. The tinsel core does not carry the heating current flowing through the wire but serves merely to pick up current leakage from the heating wire through the separation layer. That leakage current increases with increasing temperature and the magnitude of the leakage current is used to control the power delivered to the heating wire.

In the known product, only one parameter of the heating cable is monitored, that is the conductivity of the NTC separation layer. Generally the cable will be supplied with a controller which also has a circuit designed to cut off the supply of power if the current drawn by the heating element exceeds a predetermined threshold and thus the overall assembly can be considered as a two-safety feature system. Simple over current protection however is generally not effective in avoiding the occurrence of "hot spots" along the length of the heating cable. Furthermore given that the main heating current flows only down the heating wire and not down the tinsel core electromagnetic radiation is emitted by the cable and therefore the EMF issue is not addressed.

In a development of the basic concept of relying upon an NTC separation layer to detect overheating, it has been proposed to use a separation layer which is both NTC and fusible. Such an arrangement is described in U.S. Pat. No. 6,310,332. In the described arrangement, normal power supply control is achieved by monitoring the NTC characteristics of the separation layer. If however abnormally high temperatures are reached at any point along the length of the heating cable the separation layer will melt, enabling the two conductors of the coaxial assembly to come into direct contact, thereby causing a short circuit between the two conductors. Such a short circuit is easy to detect and is used to cut off the power supply. Once this has occurred the product is of course effectively destroyed as it cannot be returned to a normal operative condition.

Figure 2:
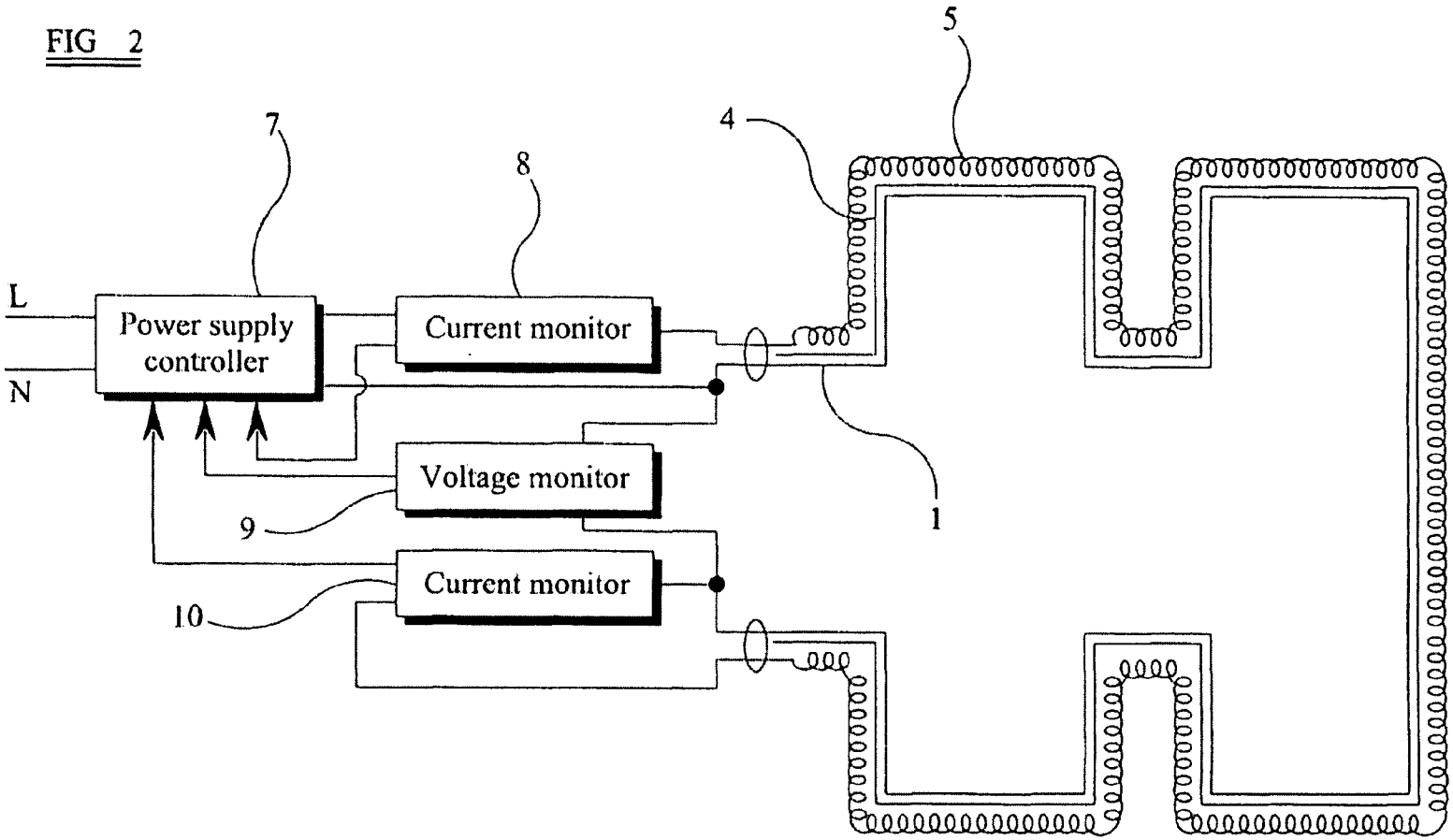

U.S. Pat. No. 6,310,332 describes two embodiments, that is the embodiment of FIG. 1 and the "more functional" embodiment of FIGS. 2 and 3. In the embodiment of FIGS. 2 and 3 one conductor carries the heating current whereas the other is used for sensing purposes. The sensing conductor may also have a positive resistance characteristic (PTC) to provide an additional means for monitoring temperature along the length of the cable. With that arrangement however the EMF issue is not addressed as the sensing cable does not carry the heating current. In the embodiment of FIG. 1 in contrast, two heating cables are connected in series by a diode, heating current passing through each of the heating wires. This arrangement does address the EMF issue as current in the two heating wires flows in opposite directions along the cable, but there is no PTC sensing element, leakage of current through the separation layer being detected by the appearance of a current flowing in the opposite direction to the direction of flow of current through the diode connecting the two heating wires together.

The NTC and fusible separation layers when arranged as in FIG. 1 does address the EMF issue and provides two overheat detection features, that is by sensing variations in the resistance of the separation layer as a result of changes in temperature and detecting melt down of the separation layer in the even of an abnormally high temperature occurring. Both of these overheat detection systems are however dependent upon the characteristics of a single component, that is the extruded separation layer. To be effective, this means that the separation layer must be manufactured to very high tolerances. For example, if the separation layer is not of the correct thickness, the NTC response to changes in temperature will not be as required to enable safe overheat detection. Similarly, if the chemical composition of the separation layer is not tightly controlled, both the NTC characteristics and the melting temperature of the separation layer may be outside ranges where safety is maintained.

New Zealand patent number 243204 describes a coaxial heating cable which does address the EMF safety issue by providing a doubled heating cable wound to reduce electromagnetic field emissions. The described cable deals with the EMF issue, but is only capable of monitoring one characteristic of the cable with a view to avoiding overheating.

It is an object of the present invention to provide a heating blanket and a cable for use in a heating blanket with improved operational characteristics.

According to the present invention, there is provided a heating cable comprising a first conductor which extends along the length of the cable, a second conductor which extends along the length of the cable, a separation layer which extends along the length of the cable and is interposed between the first and second conductors, and an outer insulating jacket extending along the length of the cable and around the first and second conductors and the separation layer, wherein the first and second conductors are connected at one end of the cable in series such that if the first and second conductors are connected at the other end of the cable to respective poles of a power supply equal currents flow in opposite directions through adjacent portions of the conductors, the first conductor is formed such that it has a positive temperature characteristic, and the separation layer is formed such that the electrical resistance it provides between adjacent portions of the conductors reduces with increasing temperatures.

The first and second conductors may be coaxial and the separation layer may be tubular, the first conductor being located inside the tubular separation layer and the second conductor being located outside the tubular separation layer.

Preferably the first conductor is formed from twisted together components each of which comprises a fibre core around which a positive temperature characteristic wire has been wrapped to form a helix. The second conductor may be a heating wire wrapped around the tubular separation layer to form a helix.

The separation layer may be formed such that it has a negative temperature characteristic. Alternatively or in addition, the separation layer may be formed such that it melts if heated to a predetermined threshold temperature.

When the cable is connected to a power supply, the first and second conductors are connected in series across the poles of the power supply. The end to end resistance of the first conductor is monitored, and the supply of power to the cable is controlled as a function of the monitored resistance, for example such that the power supplied is gradually reduced with gradually increasing monitored resistance. Current flowing through the separation layer either as a result of a reduction in resistance due to an increase in temperature of the NTC material or as a result of meltdown of at least a portion of the separation layer such that the first and second conductors come into contact with each other is also used to control the supply of power. The supply of power to the cable can be terminated immediately the monitored current exceeds a predetermined threshold.

Embodiments of the present invention will now be described, by way of example, with reference to the accompanying drawings, in which:

FIG. 1 illustrates the physical structure of a heating cable in accordance with the present invention; and FIG. 2 schematically illustrates the relationship between a cable such as that illustrated in FIG. 1 and a power supply arrangement in a heating blanket in accordance with the present invention.

Referring to FIG. 1, this illustrates the structure of the heating cable in accordance with the present invention. The cable comprises a central core 1 in the form of a twisted together bundle of four components each of which comprises a central fibre core 2 which provides mechanical strength and which is wrapped by a helically extending wire 3 manufactured from a material which provides a positive temperature co-efficient (PTC). The core 1 has a separation layer 4 extruded onto it and the heating wire 5 is wound onto the separation layer 4 to form a helix. An extruded jacket 6 of waterproof and electrically insulating material completes the cable assembly.

Referring to FIG. 2, this schematically represents the circuit of an electric blanket including a controller and incorporating a cable such as that illustrated in FIG. 1. The core of the cable is represented by line 1, the separation layer by line 4 and the heating wire by the line 5. Both ends of the cable are connected to the power supply circuit which includes a controller 7, a first current monitor 8, a voltage monitor 9 and a second current monitor 10. Each of the current and voltage monitors provides an output representative of the monitored parameter to the controller 7. The controller uses these three inputs to monitor the condition of the cable and control the supply of power to the cable. One end of the core 1 may be connected via controller 7 to the negative pole of an AC supply, one end of the heating wire 5 may be connected via current monitor 8 and controller 7 to the live pole of the AC supply, and the other ends of the core 1 and wire 5 are effectively shorted together via current monitor 10.

In the first embodiment of the invention, the separation layer 4 which is interposed between the core 1 and heating wire 5 is manufactured from a material which has a negative temperature co-efficient (NTC). As a result, as the temperature increases at any location along the length of the cable, the local resistance of the separation layer 4 decreases, and therefore the current leaking through the separation layer 4 increases. This leakage current is used as one of the control parameters of the cable. The core 1 exhibits a positive temperature co-efficient (PTC) and therefore as the temperature of the cable increases the end to end resistance of the core 1 increases. This increase in resistance is used as another control parameter.

The end to end resistance of the core 1 is monitored by monitoring the resistance between the two ends of the core using knowledge of the voltage applied to and current through the core. The output of the voltage monitor 9 can be used to modulate the power supplied by the controller 7 so as to maintain a stable cable temperature. The controller 7 may be provided with user-operable switches to adjust the normal rate at which power is supplied to suit a particular user's requirements.

With regard to monitoring the current leakage through the separation layer 4, if there was no leakage the current monitored by current monitors 8 and 10 would be identical. The magnitude of the leakage current is equal to the difference between the currents through current monitors 8 and 10. The controller 7 could be used to gradually reduce the power supplied in response to increases in leakage current, the total current being reduced to zero if the leakage current exceeds a predetermined threshold. Alternatively, the controller 7 may be unresponsive to the monitored leakage current until a threshold is reached, at which point the controller would simply terminate the supply of power.

Given that the circuit is operative to monitor the end to end resistance of the PTC core 1 end is also operative to monitor the magnitude of current leaking through the separation layer 4 the two safety monitoring systems are essentially independent. A manufacturing error which made one of the sensing systems ineffective, for example errors in the thickness or the constitution of the separation layer 4, would not also render the other sensing system in effective. Furthermore, the circuit monitoring current leakage through the separation layer 4 is sensitive to any leakage current even if all of the leakage current occurs in a very localised portion of the cable. The circuit is therefore highly sensitive to the development of localised hot spots.

With regard to the EMF issue, given that power is supplied to one end only of the cable, and that the core 1 and heating wire 5 are connected in series as a result of being connected together at the other end of the cable via current monitor 10, even if there is some leakage current through the separation layer 4 at any point along the length of the cable substantially identical currents pass through adjacent positions of the core 1 and heating wire 5, those currents being in opposite directions to each other. As a result there is substantially no electromagnetic radiation emitted from the cable.

As an alternative to the separation layer 4 being fabricated from an NTC material, the separation layer 4 can be fabricated from a fusible material which will melt if the local temperature exceeds a predetermined threshold. When such melting occurs, given that the assembly is enclosed in the extruded jacket 6 (FIG. 1), and that the heating wire 5 is wound around the separation layer 4, the core 1 and wire 5 will come into contact and effectively short out the cable. This will be immediately detected as there will be a rapid fall of current through the current monitor 10 as a result of the flow of current between the short circuited core 1 and heating wire 5. If the short circuit occurs close to the end of the cable to which power is supplied, the current drawn will rapidly rise, and this can be detected simply as an over current condition, enabling the controller to terminate the supply of power. If the short circuit occurs close to the other end of the cable across which the current monitor 10 is connected, the short circuit current will still result in the current through the current monitor 10 falling, enabling the controller to respond to the resultant difference between the currents sensed by the monitors 8 and 10 to terminate the supply.

It will be appreciated that each of the described systems provides three independent safety features, that is inherently low electromagnetic radiation, temperature sensing by monitoring the resistance of the PTC core 1, temperature sensing by monitoring current through the separation layer 4 (NTC response or meltdown). It is also the case of course that the separation layer could be manufactured from a material which is both NTC and fusible at a threshold temperature corresponding to localised overheating.

It will be appreciated that the various components of the described cable can be fabricated from conventional materials. For example, the "tinsel" core 1 can be fabricated using standard equipment and materials. All that is required is an end to end resistance of the core 1 which increases with temperature. A copper or copper/cadmium wire incorporated in the core 1 can exhibit sufficient PTC characteristics. An end to end resistance when cold are as little as a few tens of ohms can develop a voltage drop sufficiently large for reliable detection of increasing voltage drop with temperature. With regard to the separation layer 4, suitably prepared polyethylene may be used to act as a fusible layer and/or to act as an NTC layer. The heating wire 5 can be entirely conventional, as can the material used to form the outer insulation jacket.

It will be appreciated that the circuit schematically illustrated in FIG. 2 is but one possible configuration of circuitry capable of performing the necessary functions, that is monitoring the end to end resistance of the PTC core 1 and monitoring current leakage through the separation layer 4.

The invention claimed is:

1. A heating cable comprising:

a first conductor which extends along the length of the cable;

a second conductor which extends along the length of the cable;

a separation layer which extends along the length of the cable and is interposed between the first and second conductors; and an outer insulating jacket extending along the length of the cable and around the first and second conductors and the separation layer;

wherein the first and second conductors are connected at a first end of the cable in series such that current can flow in both directions through the first and second conductors and when the first and second conductors are connected at a second end of the cable to an AC power supply equal currents flow in opposite directions through adjacent portions of the first and second conductors; and wherein the separation layer is formed such that the separation layer has a negative temperature characteristic, and the first conductor is formed such that the first conductor has a positive temperature characteristic.

2. A heating cable according to claim 1, wherein the first and second conductors are coaxial and the separation layer is tubular, the first conductor being located inside the tubular separation layer and the second conductor being located outside the tubular separation layer.

3. A heating cable according to claim 2, wherein the first conductor is formed from twisted together components each of which comprises a fibre core around which a positive temperature coefficient wire has been wrapped to form a helix.

4. A heating cable according to claim 2, wherein the second conductor is a heating wire wrapped around the tubular separation layer to form a helix.

5. A heating cable according to claim 3, wherein the second conductor is a heating wire wrapped around the tubular separation layer to form a helix.

6. A heating cable according to claim 1, wherein the separation layer is formed such that the separation layer melts if heated to a predetermined threshold temperature.

* * * * *